US005894767A

United States Patent [19]

Wridt et al.

[11] Patent Number: 5,894,767

[45] Date of Patent: Apr. 20, 1999

[54] SPOKE WRENCH

[75] Inventors: Gerald A. Wridt, Racine; Mark J. Hasenberg, Kenosha; Wendell J. Woodruff, Monona, all of Wis.

[73] Assignees: Snap-on Technologies, Inc., Lincolnshire, Ill.; Trek Bicycle Corporation, Waterloo, Wis.

[21] Appl. No.: 08/911,446

[22] Filed: Aug. 14, 1997

Related U.S. Application Data

[63] Continuation of application No. 08/616,624, Mar. 15, 1996, abandoned.

[51] Int. Cl.[6] ..... B25B 13/02

[52] U.S. Cl. ..... 81/119; 81/125.1; 81/124.2; 81/DIG. 7

[58] Field of Search ..... 81/119, 125.1, 81/124.2, 186, DIG. 7

[56] References Cited

U.S. PATENT DOCUMENTS

| | | | |
|---|---|---|---|
| D. 29,339 | 9/1898 | Birk | D8/28 |
| D. 32,744 | 5/1900 | Cabana . | |
| 86,802 | 2/1869 | Baxter . | |
| D. 154,326 | 6/1949 | Roysher . | |
| D. 159,036 | 6/1950 | Baehr . | |
| D. 162,867 | 4/1951 | Olson . | |
| D. 245,062 | 7/1977 | Grame . | |
| D. 252,554 | 8/1979 | Lancer . | |
| D. 292,549 | 11/1987 | Rixen . | |
| 564,151 | 7/1896 | Jacoby . | |
| 564,625 | 7/1896 | Kelsea . | |
| 622,005 | 3/1899 | Herrick . | |
| 628,414 | 7/1899 | O'Leary . | |
| 648,135 | 6/1900 | Taggart . | |
| 1,247,328 | 11/1917 | Reams . | |
| 1,851,426 | 3/1932 | Haskell . | |
| 2,800,816 | 7/1957 | Tasciotti . | |
| 2,959,995 | 11/1960 | Linden . | |
| 3,772,943 | 11/1973 | Itano . | |
| 3,931,749 | 1/1976 | Evans | 81/119 |
| 4,791,837 | 12/1988 | Main . | |
| 5,297,458 | 3/1994 | Smith . | |

FOREIGN PATENT DOCUMENTS

| | | | |
|---|---|---|---|
| 22579 | 11/1893 | United Kingdom | 81/119 |

OTHER PUBLICATIONS

Photograph of the VAR & Lifu spoke wrenches. Prior to filing date of application.

Park Tool Catalog 1996 (cover page and p. 8), 1996.

*Primary Examiner*—James G. Smith

*Attorney, Agent, or Firm*—Emrich & Dithmar

[57] ABSTRACT

A wrench for a wheel spoke nipple is provided. The wrench includes a body having an axis and first and second axial ends, the first axial end having first and second engagement notches for engaging spoke nipples, and the second axial end having third and fourth engagement notches for engaging spoke nipples. The wrench may also include a central portion disposed between the first and second axial ends, the central portion having first and second radial engaging portions for engagement with a user's fingers or thumb. Each engaging portion having an inner radial end and an outer radial end. Each engaging portion also having first and second oppositely contoured concave faces disposed between the inner and outer radial ends wherein the distance between the first and second oppositely contoured faces of the first engaging portion increases between the inner and outer radial ends.

13 Claims, 1 Drawing Sheet

SPOKE WRENCH

CROSS REFERENCE TO RELATED APPLICATION

This is a continuation of U.S. Ser. No. 08/616,624, filed Mar. 15, 1996 and entitled "Improved Spoke Wrench", abandoned.

BACKGROUND OF THE INVENTION

1. Field of the Invention

This invention relates to wrenches, and more particularly to wrenches for engaging the nipples of bicycle wheel spokes, commonly known as "spoke wrenches".

2. Description of the Prior Art

One-piece spoke wrenches having engaging notches to tighten or loosen bicycle spoke nipples have previously been provided. These prior spoke wrenches are inadequate because they usually have only one size engaging notch, thereby requiring a different spoke wrench for each different size of spoke nipple. These spoke wrenches also typically have opposite flat planar surfaces for engagement by the user's thumb and fingers to rotate the spoke wrench (and an engaged spoke nipple). Users typically have trouble strongly engaging these planar surfaces and often their fingers and thumb slip off these surfaces.

SUMMARY OF THE INVENTION

It is a general object of the invention to provide an improved spoke wrench which avoids the disadvantages of prior spoke wrenches while affording additional structural and operating advantages.

An important feature of the invention is the provision of a spoke wrench which is of relatively simple and economical construction.

A further feature of the invention is the provision of a spoke wrench of the type set forth which can be used to engage four differently sized spoke nipples.

A still further feature of the invention is the provision of a spoke wrench of the type set forth, which has engaging surfaces that aid in preventing user disengagement therefrom.

These and other features of the invention are attained by providing a wrench for a wheel spoke nipple including a body having an axis and first and second axial ends. The first axial end has first and second engagement notches for engaging spoke nipples, and the second axial end having third and fourth engagement notches for engaging spoke nipples.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 4:
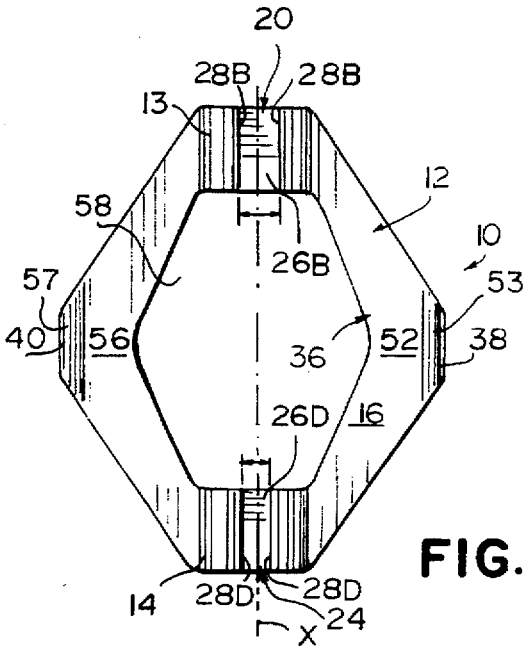
FIG. 4 is a rear elevational view of the spoke wrench of FIG. 2.

Referring to the drawings, a spoke wrench 10 is illustrated. The spoke wrench 10 includes a one-piece body 12 having an axis "X" (FIG. 4). The body 12 has a first axial end 13, a second axial end 14, a first face 15 and a second face 16. The first and second faces 15, 16 are substantially mirror images of each other.

The first axial end 13 has first and second generally U-shaped engaging notches 18, 20, respectively opening at the first face 15 and second face 16. The second axial end 14 has third and fourth generally U-shaped engaging notches 22, 24, respectively opening at the first and second faces 15, 16. The first, second, third and fourth engaging notches 18, 20, 22, 24 respectively have first, second, third and fourth bight faces 26A–D, each respectively connecting and substantially perpendicular to first, second, third and fourth pairs of substantially parallel leg faces 28A–D.

Each notch 18, 20, 22, 24 is designed to engage a bicycle spoke nipple 30 in order to tighten or loosen (in a known fashion) a spoke 32 of a bicycle wheel 34, to which the spoke nipple 30 is connected.

In that regard, the bight faces 26A–D and the pairs of leg faces 28A–D may have the same or different dimensions, so that the first, second, third and fourth engaging notches 18, 20, 22, 24 may each be dimensioned to engage the same or different size spoke nipples, thereby allowing the spoke wrench to be used with from one to four different spoke nipples.

As seen in the drawings, the first, second, third and fourth engaging notches 18, 20, 22, 24 are dimensioned differently to respectively engage four differently sized spoke nipples. While each pair of leg faces 28A, 28B, 28C, 28D has substantially the same length, as measured from each bight face 26A, 26B, 26C, 26D to the respective first or second face 15, 16 where the engaging notch opens, each bight face 26A–D has a different width, as measured by the distance between each respective pair of leg faces 28A–D the bight face 26A–D connects.

Figure 1:
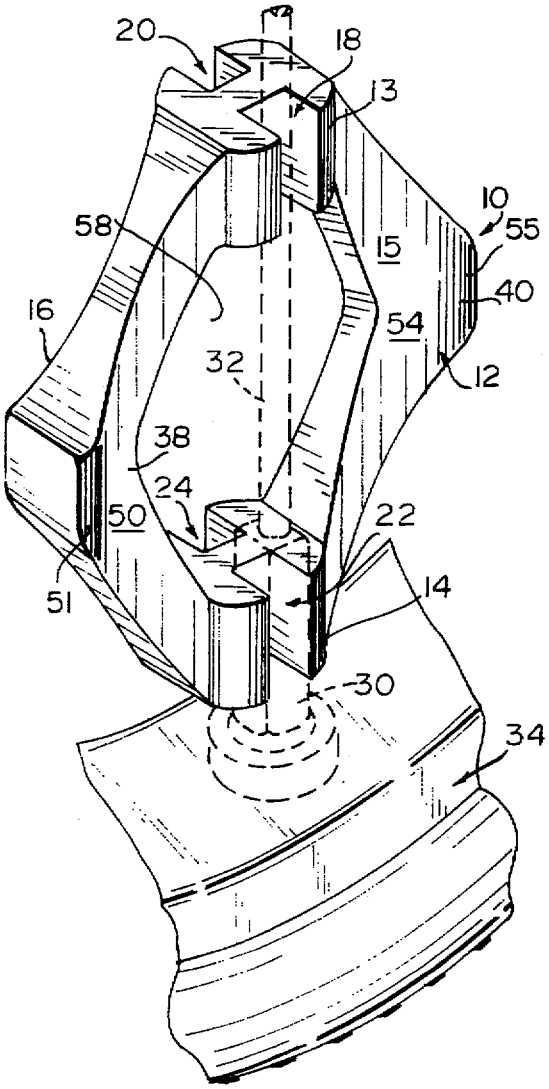
FIG. 1 is a perspective view of the spoke wrench of the present invention engaged with a bicycle spoke nipple shown in phantom.
Figure 2:
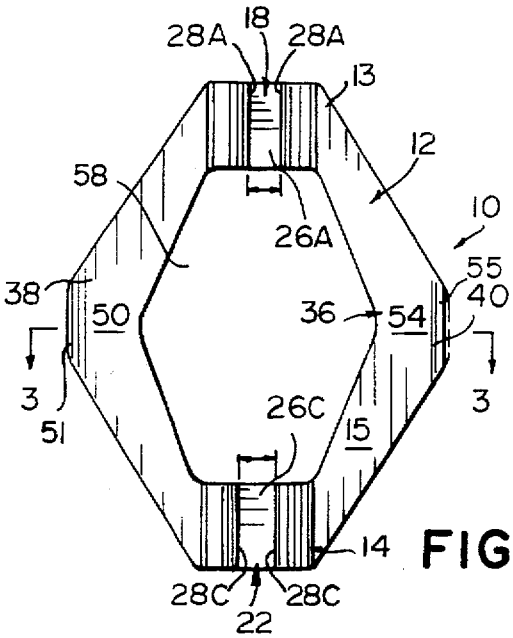
FIG. 2 is a reduced front elevational view of the spoke wrench of FIG. 1.

As discussed further below and as seen in FIGS. 1 and 2, the first engaging notch 18 lies in axial alignment with the third engaging notch 22, so that the bight faces 26A and 26C of the first and second engaging notches 18 and 22 are substantially coplanar. Likewise, the second engaging notch 20 lies substantially in axial alignment with the fourth engaging notch 24 and the bight faces 26B and 26D are substantially coplanar.

Figure 3:
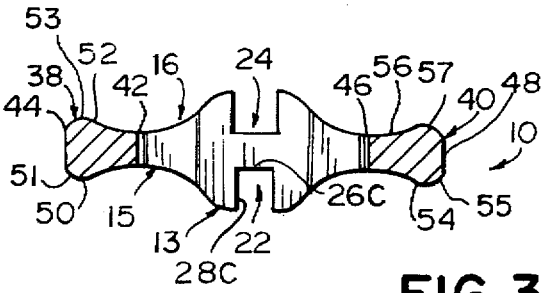
FIG. 3 is a sectional view taken generally along the line 3—3 of FIG. 2.

The body 12 also has a central engaging portion 36 disposed between the first and second axial ends 13, 14. The central engaging portion 36 has first and second radial engaging portions 38, 40 disposed at opposite radial ends of the body 12. As best seen in FIG. 3, the first radial engaging portion 38 has a first inner radial end 42 and first outer radial end 44 further from the axis of the body 12. Likewise, the second radial engaging portion 40 has a second inner radial end 46 and a second outer radial end 48 further from the axis of the body 12.

The first and second radial engaging portions 38, 40 have scalloped or dished shapes. The first engaging portion 38 has first and second oppositely contoured concave faces 50, 52 which are essentially mirror images of each other and which are disposed between the first inner radial end 42 and first outer radial end 44, with the distance between the first and second oppositely contoured faces 50, 52 increasing from the first inner radial end 42 toward the first outer radial end 44. The first engaging portion 38 also has first and second oppositely contoured convex faces 51, 53 respectively contiguous with concave faces 50 and 52 and respectively extending to outer radial end 44. The first and second oppositely contoured convex faces 51,53 are essentially mirror images of each other.

Similarly, the second radial engaging portion 40 has first and second oppositely contoured concave faces 54, 56 which are essentially mirror images of each other and which are disposed between the second inner radial end 46 and the second outer radial end 48, with the distance between the first and second opposite contoured faces 50, 52 increasing from the second inner radial end 46 toward the second outer radial end 48. The second engaging portion 40 also has first and second oppositely contoured convex faces 55, 57 respectively contiguous with concave faces 54 and 56 and respectively extending to outer radial end 48. The first and second oppositely contoured convex faces 55,57 are essentially mirror images of each other.

As discussed below, the first and second opposite contoured faces 50, 52 of the first engaging portion 38 and the first and second opposite contoured faces 54, 56 of the second engaging portion 40 provide a user with more convenient and efficient finger and thumb hold positions.

The spoke wrench 10 may be used as follows: As seen in FIG. 1, the correct size engaging notch 22 is engaged with the spoke nipple 30. Since engaging notch 18 lies substantially in axial alignment with engaging notch 22, spoke 32 can be disposed within the notch 18 and thereby not interfere with the use of the spoke wrench 10. The disposal of the spoke nipple 30 within notch 18 also aids in maintaining the axis "X" of the body 12 in general alignment with the spoke nipple 30 to facilitate use of the spoke wrench 10 and to maintain engagement between the engaging notch 22 and the spoke nipple 30.

After engaging notch 22 has been engaged with the spoke nipple 30, a user then engages one of the first contoured faces 50, 54 of one engaging portion with his thumb and the second contoured face 52, 56 of the other engaging portion with his fingers to rotate the spoke wrench 10 about its axis. For example, if a user wishes to rotate the spoke nipple 30 of FIG. 1 clockwise, as viewed in FIG. 1, he may engage the first contoured face 50 of the first radial engaging portion 38 with his thumb and the second contoured face 56 of the second radial engaging portion 40 with his finger(s) and then rotate the spoke wrench 10 clockwise as far as possible (approximately 180 degrees). The user then readjusts his hand so that he engages the first contoured face 52 of the first radial engaging portion 38 with his thumb and the second contoured face 56 of the second radial engaging portion 40 with his finger(s) and continues to rotate the spoke wrench 10 clockwise. This hand readjustment after each half-turn rotation of the spoke wrench 10 continues as necessary.

It is believed that the contoured shape of faces 50, 52, 54, 56 allows the user to apply more torque with the spoke wrench 10 to the spoke nipple 30, while expending less energy than if the radial engaging portions 38, 40 had opposite flat planar faces. It is also believed that the concavity of the faces prevents a user's finger(s) or thumb from slipping off the radial ends of the spoke wrench 10 when the user is engaging the first and second radial engaging portions 38, 40.

The spoke wrench 10 may be made out of a metal or other suitably strong material, such as a suitable plastic. The body 12 of the spoke wrench 10 advantageously has a central hexagon-shaped aperture 58 separating the axial ends 13, 14 and the radial engaging portions 38, 40 to decrease the weight of, and the amount of material needed to construct, the spoke wrench 10.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A wrench for a wheel spoke nipple comprising:

a body having an axis and first and second axial ends;

a first engagement notch disposed on the first axial end for engaging a spoke nipple; and a central portion disposed between the first and second axial ends, the central portion having first and second radial engaging portions for engagement with a user's fingers or thumb, each engaging portion having an inner radial end and an outer radial end, each engaging portion having first and second oppositely contoured concave face portions disposed between the inner and outer radial ends and first and second oppositely contoured convex face portions respectively contiguous with associated first and second concave face portions and each extending radially to the outer radial end.

2. The wrench of claim 1, wherein the distance between the first and second oppositely contoured concave face portions of the first engaging portion increases from the inner radial end toward the outer radial end.

3. The wrench of claim 2, wherein the distance between the first and second oppositely contoured concave face portions of the second engaging portion increases from the inner radial end toward the outer radial end.

4. The wrench of claim 1, wherein each first and second oppositely contoured concave face portion is a mirror image of the other.

5. The wrench of claim 1, and further comprising a second engagement notch disposed on the first axial end.

6. The wrench of claim 5, wherein the first and second engagement notches respectively have first and second openings, wherein the first opening is disposed approximately 180 degrees from the second opening.

7. The wrench of claim 5, and further comprising third and fourth engaging notches disposed on the second axial end.

8. The wrench of claim 7, wherein the first notch has dimensions different from those of the second, third and fourth notches to engage a different size spoke nipple.

9. The wrench of claim 8, wherein the first, second, third and fourth notches respectively have different dimensions for engaging four different size spoke nipples.

10. The wrench of claim 1, and further comprising an aperture disposed between the first and second axial ends and the first and second radial engaging portions.

11. The wrench of claim 1, wherein each concave face portion extends axially across the associated engaging portion.

12. The wrench of claim 11, wherein each convex face portion extends axially across the associated engaging portion.

13. A wrench for a wheel spoke nipple comprising:

a body having an axis, an aperture, and first and second axial ends;

a first engagement notch disposed on the first axial end for engaging a spoke nipple; and a central portion disposed between the first and second axial ends, the central portion having first and second radial engaging portions for engagement with a user's fingers or thumb, each engaging portion having an inner radial end and an outer radial end, each engaging portion having first and second oppositely contoured concave face portions disposed between the inner and outer radial ends and first and second oppositely contoured convex face portions respectively contiguous with associated first and second concave face portions and each extending radially to the outer radial end, wherein the distance between the first and second oppositely contoured concave face portions of each of the engaging portions is at a minimum at the inner radial end and increases from the inner radial end toward the outer radial end, wherein the first and second inner radial ends cooperate to define a portion of the aperture.

* * * * *